US010665163B2

(12) United States Patent
Zhang et al.

(10) Patent No.: US 10,665,163 B2
(45) Date of Patent: May 26, 2020

(54) PIXEL CIRCUIT, DRIVING METHOD THEREOF, ARRAY SUBSTRATE AND DISPLAY DEVICE

(71) Applicants: Beijing BOE Display Technology Co., Ltd., Beijing (CN); BOE Technology Group Co., Ltd., Beijing (CN)

(72) Inventors: Bin Zhang, Beijing (CN); Guangxing Wang, Beijing (CN); Qiang Zhang, Beijing (CN); Wenpeng Xu, Beijing (CN); Dianzheng Dong, Beijing (CN); Pengming Chen, Beijing (CN); Kan Zhang, Beijing (CN)

(73) Assignees: BEIJING BOE DISPLAY TECHNOLOGY CO., LTD., Beijing (CN); BOE TECHNOLOGY GROUP CP., LTD., Beijing (CN)

( * ) Notice: Subject to any disclaimer, the term of this patent is extended or adjusted under 35 U.S.C. 154(b) by 0 days.

(21) Appl. No.: 16/084,079

(22) PCT Filed: Feb. 12, 2018

(86) PCT No.: PCT/CN2018/076372
§ 371 (c)(1),
(2) Date: Sep. 11, 2018

(87) PCT Pub. No.: WO2019/010977
PCT Pub. Date: Jan. 17, 2019

(65) Prior Publication Data

US 2019/0347988 A1 Nov. 14, 2019

(30) Foreign Application Priority Data

Jul. 12, 2017 (CN) ..... 2017 1 0565269

(51) Int. Cl.
*G09G 3/3233* (2016.01)
*G09G 3/3266* (2016.01)
*G09G 3/3275* (2016.01)

(52) U.S. Cl.
CPC ..... *G09G 3/3233* (2013.01); *G09G 3/3266* (2013.01); *G09G 3/3275* (2013.01); *G09G 2300/0842* (2013.01)

(58) Field of Classification Search
None
See application file for complete search history.

(56) References Cited

U.S. PATENT DOCUMENTS

2013/0113690 A1 5/2013 Ishii et al.
2014/0339998 A1 11/2014 Hsu et al.
(Continued)

FOREIGN PATENT DOCUMENTS

CN 1601594 3/2005
CN 103295528 9/2013
(Continued)

OTHER PUBLICATIONS

First Office Action and English language translation. CN Application No. 201710565269.8, dated Jun. 18, 2019, 14 pp.
(Continued)

*Primary Examiner* — Christopher J Kohlman
(74) *Attorney, Agent, or Firm* — Myers Bigel, P.A.

(57) ABSTRACT

A pixel circuit includes a light emitting device, a driving transistor for controlling a magnitude of a driving current supplied from a first power supply to the light emitting device in response to a potential at a first node, a storage capacitor for causing a change in the potential at the first node in response to a change in a potential at a second node, a first circuit for transmitting a voltage signal in a data line to the second node in response to a signal in a first scan line
(Continued)

being active, a second circuit for bringing the driving transistor into a diode-connecting state in response to a signal in a second scan line being active, and a third circuit.

16 Claims, 6 Drawing Sheets

(56) References Cited

U.S. PATENT DOCUMENTS

| | | | | |
|---|---|---|---|---|
| 2015/0187266 | A1 | 7/2015 | Qian et al. | |
| 2016/0155379 | A1 | 6/2016 | Na | |
| 2016/0343298 | A1 | 11/2016 | Xu | |
| 2017/0148387 | A1* | 5/2017 | Lin | G09G 3/3233 |
| 2017/0154572 | A1* | 6/2017 | Kim | G09G 3/3233 |

FOREIGN PATENT DOCUMENTS

| | | |
|---|---|---|
| CN | 103927975 | 7/2014 |
| CN | 104361857 | 2/2015 |
| CN | 104715724 | 6/2015 |
| CN | 105096818 | 11/2015 |
| CN | 105575331 | 5/2016 |
| CN | 106205480 | 12/2016 |
| CN | 106816136 | 6/2017 |
| KR | 20120074422 | 7/2012 |

OTHER PUBLICATIONS

International Search Report and Written Opinion of the International Searching Authority for corresponding PCT Application No. PCT/CN2018/076372 (Foreign Text, 10 pages; English Translation, 6 pages) (dated Apr. 28, 2018).

* cited by examiner

PIXEL CIRCUIT, DRIVING METHOD THEREOF, ARRAY SUBSTRATE AND DISPLAY DEVICE

CROSS REFERENCE TO RELATED APPLICATIONS

The present application is a 35 U.S.C. 371 national stage application of PCT International Application No. PCT/CN2018/076372, filed on Feb. 12, 2018, which claims the benefit of Chinese patent application No. 201710565269.8, filed on Jul. 12, 2017, the contents of which are incorporated herein by reference in their entireties.

FIELD

The present disclosure pertains to the field of display technologies, and specifically relates to a pixel circuit, a method for driving the pixel circuit, an array substrate and a display panel.

BACKGROUND

In a typical organic light emitting diode display panel, luminance unevenness may occur among pixels due to a drift in a threshold voltage of a driving transistor in each pixel. This is attributed to the fact that the current flowing through a light emitting diode in each pixel is generally related to the threshold voltage of the driving transistor. This may result in deterioration of display effect.

SUMMARY

It is advantageous to provide a mechanism that can alleviate, mitigate or eliminate one or more of the above problems.

According to an aspect of the present disclosure, there is provided a pixel circuit comprising: a light emitting device; a driving transistor for controlling a magnitude of a driving current supplied from a first power supply to the light emitting device in response to a potential at a first node; a storage capacitor for causing a change in the potential at the first node in response to a change in a potential at a second node; a first circuit for transmitting a voltage in a data line to the second node in response to a signal in a first scan line being active; a second circuit for bringing the driving transistor into a diode-connecting state in response to a signal in a second scan line being active; and a third circuit for providing a path that allows the driving current to flow from the first power supply to a second power supply via the driving transistor and the light emitting device in response to a signal in a third scan line being active.

In some exemplary embodiments, the driving transistor comprises a gate connected to the first node and a drain connected to a third node.

In some exemplary embodiments, the storage capacitor is connected between the first node and the second node.

In some exemplary embodiments, the first circuit comprises a first transistor including a gate connected to the first scan line, a first terminal connected to the data line, and a second terminal connected to the second node.

In some exemplary embodiments, the second circuit comprises a second transistor including a gate connected to the second scan line, a first terminal connected to the first node, and a second terminal connected to the third node.

In some exemplary embodiments, the third circuit comprises a third transistor including a gate connected to the third scan line, a first terminal connected to the third node, and a second terminal connected to a fourth node.

In some exemplary embodiments, the pixel circuit further comprises a fourth transistor connected between the second node and the fourth node for bringing the second node into conduction with the fourth node in response to the signal in the second scan line being active.

In some exemplary embodiments, the driving transistor is a P-type transistor including a source connected to the first power supply, and the light emitting device is connected between the fourth node and the second power supply.

In some exemplary embodiments, the driving transistor is an N-type transistor including a source connected to the second power supply, and the light emitting device is connected between the first power supply and the fourth node.

In some exemplary embodiments, the light emitting device comprises an organic light emitting diode.

According to another aspect of the present disclosure, there is provided an array substrate comprising: a plurality of first scan lines for transmitting first scan signals; a plurality of second scan lines for transmitting second scan signals; a plurality of third scan lines for transmitting third scan signals; a plurality of data lines for transmitting voltage signals; and a plurality of pixels arranged in an array, each of the plurality of pixels comprising: a light emitting device; a driving transistor for controlling a magnitude of a driving current supplied from a first power supply to the light emitting device in response to a potential at a first node; a storage capacitor for causing a change in the potential at the first node in response to a change in a potential at a second node; a first circuit for transmitting a voltage signal in a corresponding one of the plurality of data lines to the second node in response to a first scan signal in a corresponding one of the plurality of first scan lines being active; a second circuit for bringing the driving transistor into a diode-connecting state in response to a second scan signal in a corresponding one of the plurality of second scan lines being active; and a third circuit for providing a path that allows the driving current to flow from the first power supply to a second power supply via the driving transistor and the light emitting device in response to a third scan signal in a corresponding one of the plurality of third scan lines being active.

According to a further aspect of the present disclosure, there is provided a display device comprising: the array substrate described above; a first scan driver for supplying the first scan signals to the plurality of first scan lines; a second scan driver for supplying the second scan signals to the plurality of second scan lines; a third scan driver for supplying the third scan signals to the plurality of third scan lines; and a data driver for supplying the voltage signals to the plurality of data lines.

According to yet another aspect of the present disclosure, there is provided a method for driving a pixel circuit described above, comprising: transmitting, by the first circuit, a reference voltage in the data line to the second node in an initialization and compensation phase; bringing, by the second circuit, the driving transistor into a diode-connecting state in the initialization and compensation phase; transmitting, by the first circuit, a data voltage in the data line to the second node in a writing phase, thereby causing a change in the potential at the second node; causing, by the storage capacitor, a change in the potential at the first node in response to the change in the potential at the second node in the writing phase; controlling, by the driving transistor, a magnitude of the driving current supplied from the first power supply to the light emitting device in response to the potential at the first node in a light emitting phase; and providing, by the third circuit, a path allowing the driving current to flow from the first power supply to the second power supply via the driving transistor and the light emitting device in the light emitting phase, thereby driving the light emitting device to emit light.

In some exemplary embodiments, the method further comprises: maintaining the potential at the first node and the potential at the second node in a maintaining phase between the writing phase and the light emitting phase.

In some exemplary embodiments, the method further comprises: in the maintaining phase, supplying an inactive signal to the first scan line, supplying an inactive signal to the second scan line, and supplying an inactive signal to the third scan line.

In some exemplary embodiments, the method further comprises: in the initialization and compensation phase, supplying an active signal to the first scan line, supplying an active signal to the second scan line, supplying an inactive signal to the third scan line, and supplying the reference voltage to the data line; in the writing phase, supplying an active signal to the first scan line, supplying an inactive signal to the second scan line, supplying an inactive signal to the third scan line, and supplying the data voltage to the data line; and in the light emitting phase, supplying an inactive signal to the first scan line, supplying an inactive signal to the second scan line, and supplying an active signal to the third scan line.

These and other aspects of the present disclosure will be apparent from and elucidated with reference to embodiments described below.

DETAILED DESCRIPTION

It will be understood that, although terms such as "first", "second", "third" and the like may be used herein to describe various elements, components and/or portions, these elements, components and/or portions should not be limited by these terms. These terms are only used to distinguish one element, component or potion from another. Thus, a first element, component or portion, which is discussed below, may be referred to as a second element, component or portion without departing from the teachings of the present disclosure.

The terms used herein is only for the purpose of describing particular embodiments and is not intended to limit the present disclosure. As used herein, the singular forms "a", "an" and "the" are intended to also include plural forms, unless explicitly defined otherwise in the context. It will be further understood that the terms "comprising" and/or "including", when used in the specification, specify the presence of a feature, entirety, step, operation, element and/or component involved, but do not exclude the presence or addition of one or more other features, entireties, steps, operations, elements, components, and/or groups thereof. As used herein, the term "and/or" includes any and all combinations of one or more of the associated items listed.

It will be understood that when an element is referred to as "connected to another element" or "coupled to another element", it may be directly connected to another element or directly coupled to another element, or an intermediate element may be present. In contrast, when an element is referred to as "directly connected to another element" or "directly coupled to another element", there is no intermediate element.

All the terms (including technical and scientific terms) used herein have the same meanings as commonly understood by a person having ordinary skill in the art to which the present disclosure pertains, unless otherwise defined. It will be further understood that terms such as those defined in commonly used dictionaries should be interpreted as having meanings consistent with their meanings in the relevant art and/or context of the specification, and will not be explained in an idealized or too formal sense, unless explicitly defined herein.

Figure 1:
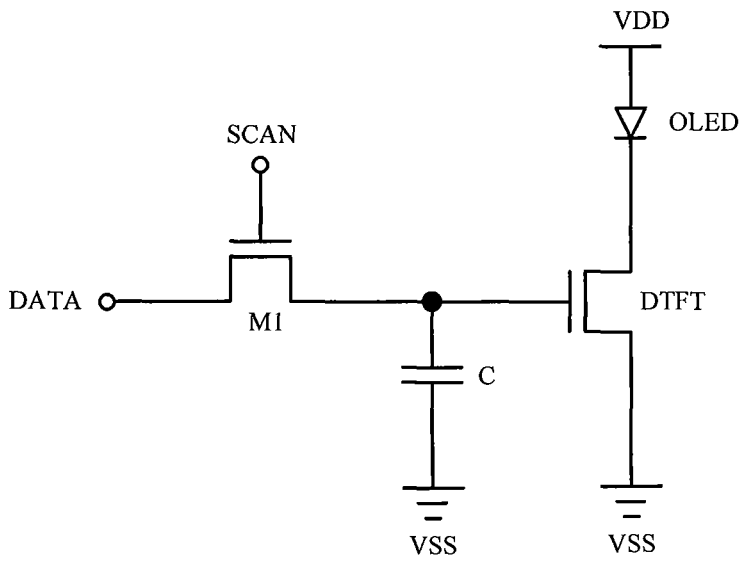
(related art) Fig.1
FIG. 1 is a circuit diagram of a typical pixel circuit.

FIG. 1 illustrates a simple 2T1C (two transistors and one capacitor) pixel circuit. When a scan line SCAN is selected, a switching transistor M1 is turned on and a data voltage in a data line DATA charges a capacitor C. The voltage across the capacitor C controls a drain current (also referred to herein as driving current) of a driving transistor DTFT. When the scan line SCAN is not selected, the switching transistor M1 is turned off and charges stored in the capacitor C maintain a gate voltage of the driving transistor DTFT, so that the driving transistor DTFT remains turned on, providing the drain current for driving an organic light emitting diode OLED to emit light. Since the drain current of the driving transistor DTFT is related to the threshold voltage of the driving transistor DTFT, the threshold voltage drift of the driving transistor DTFT causes a change in the drain current. This may cause different pixels to exhibit different luminances for the same data voltage, thereby affecting the display effect.

Figure 2:
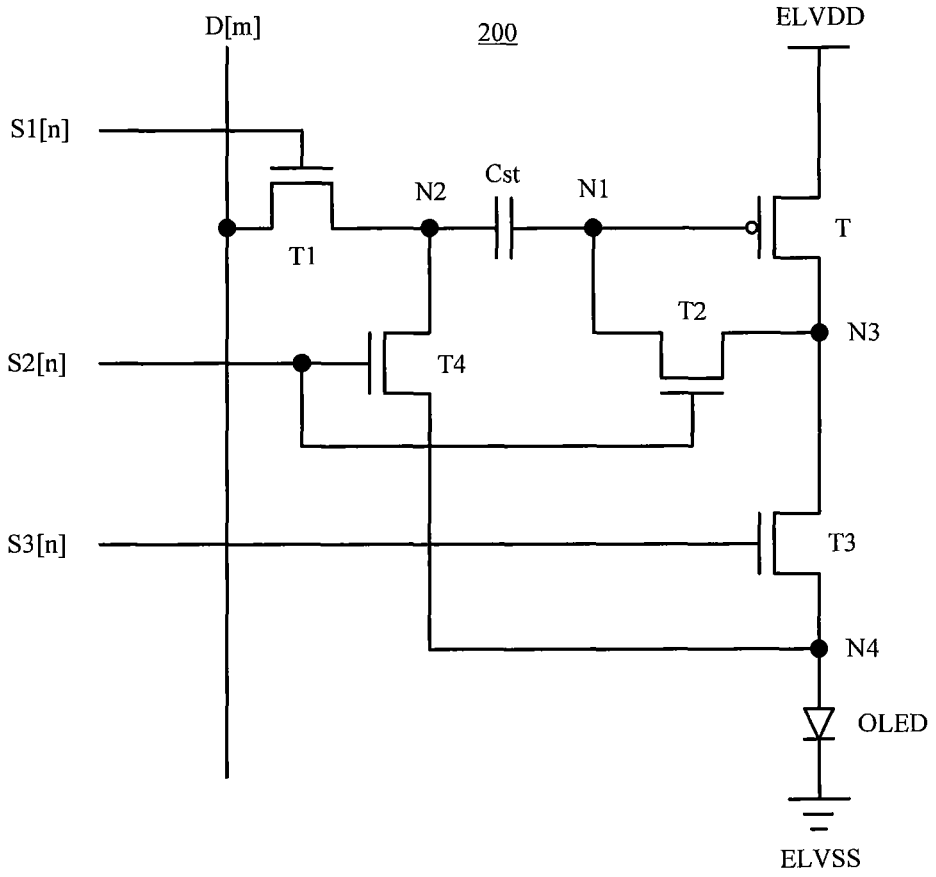
FIG. 2 is a circuit diagram of a pixel circuit according to an embodiment of the present disclosure.

FIG. 2 illustrates a circuit diagram of a pixel circuit 200 according to an embodiment of the present disclosure. As shown in FIG. 2, the pixel circuit 200 comprises a light emitting device such as an organic light emitting diode (hereinafter referred to as OLED), a driving transistor T, a storage capacitor Cst, a first circuit shown as a first transistor T1, a second circuit shown as a second transistor T2, and a third circuit shown as a third transistor T3.

The driving transistor T controls a magnitude of a driving current supplied from a first power supply ELVDD to the light emitting device OLED in response to a potential at a first node N1. Specifically, in this example, the driving transistor T is illustrated as a P-type transistor including a gate connected to the first node N1, a source connected to the first power supply ELVDD, and a drain connected to a third node N3.

The storage capacitor Cst causes a change in the potential at the first node N1 in response to a change in a potential at a second node N2. Specifically, in this example, the storage capacitor Cst is connected between the first node N1 and the second node N2.

The first circuit T1 transmits a voltage in a data line D[m] to the second node N2 in response to a signal in a first scan line S1[$n$] being active. Specifically, in this example, the first circuit T1 is illustrated as an N-type transistor including a gate connected to the first scan line S1[$n$], a first terminal connected to the data line D[m], and a second terminal connected to the second node N2. In other embodiments, the first circuit T1 may take other forms.

The second circuit T2 brings the driving transistor T into a diode-connecting state in response to a signal in a second scan line S2[$n$] being active. Specifically, in this example, the second circuit T2 is illustrated as an N-type transistor including a gate connected to the second scan line S2[$n$], a first terminal connected to the first node N1, and a second terminal connected to the third node N3. In other embodiments, the second circuit T2 may take other forms. The so-called diode-connecting state of the driving transistor T is a state in which the gate and the drain of the driving transistor T are completely or substantially short-circuited.

The third circuit T3 provides a path that allows the driving current to flow from the first power supply ELVDD to a second power supply ELVSS via the driving transistor T and the light emitting device OLED in response to a signal in a third scan line S3[$n$] being active. Specifically, in this example, the third circuit T3 is illustrated as an N-type transistor including a gate connected to the third scan line S3[$n$], a first terminal connected to the third node N3, and a second terminal connected to a fourth node N4. In other embodiments, the third circuit T3 may take other forms. The light emitting device OLED is connected in series with the third transistor T3, which has an anode connected to the fourth node N4 and a cathode connected to the second power supply ELVSS.

As used herein, the phrase "a signal being active" means that the signal has such a voltage level that a circuit element (e.g. a transistor) involved is enabled. In contrast, the phrase "a signal being inactive" means that the signal has such a voltage level that the circuit element (e.g. transistor) involved is disabled.

In some embodiments, the pixel circuit 200 may further optionally comprise a fourth transistor T4 connected between the second node N2 and the fourth node N4. As shown in FIG. 2, the fourth transistor T4 is illustrated as an N-type transistor including a gate connected to the second scan line S2[$n$], a first electrode connected to the second node N2, and a second electrode connected to the fourth node N4. The fourth transistor T4 may bring the second node N2 into conduction with the fourth node N4 in response to the signal in the second scan line S2[$n$] being active. This may be advantageous because the fourth node N4 may be set to a definite potential during initialization of the pixel circuit 200, preventing possible erroneous operations of the pixel circuit 200.

Figure 3:
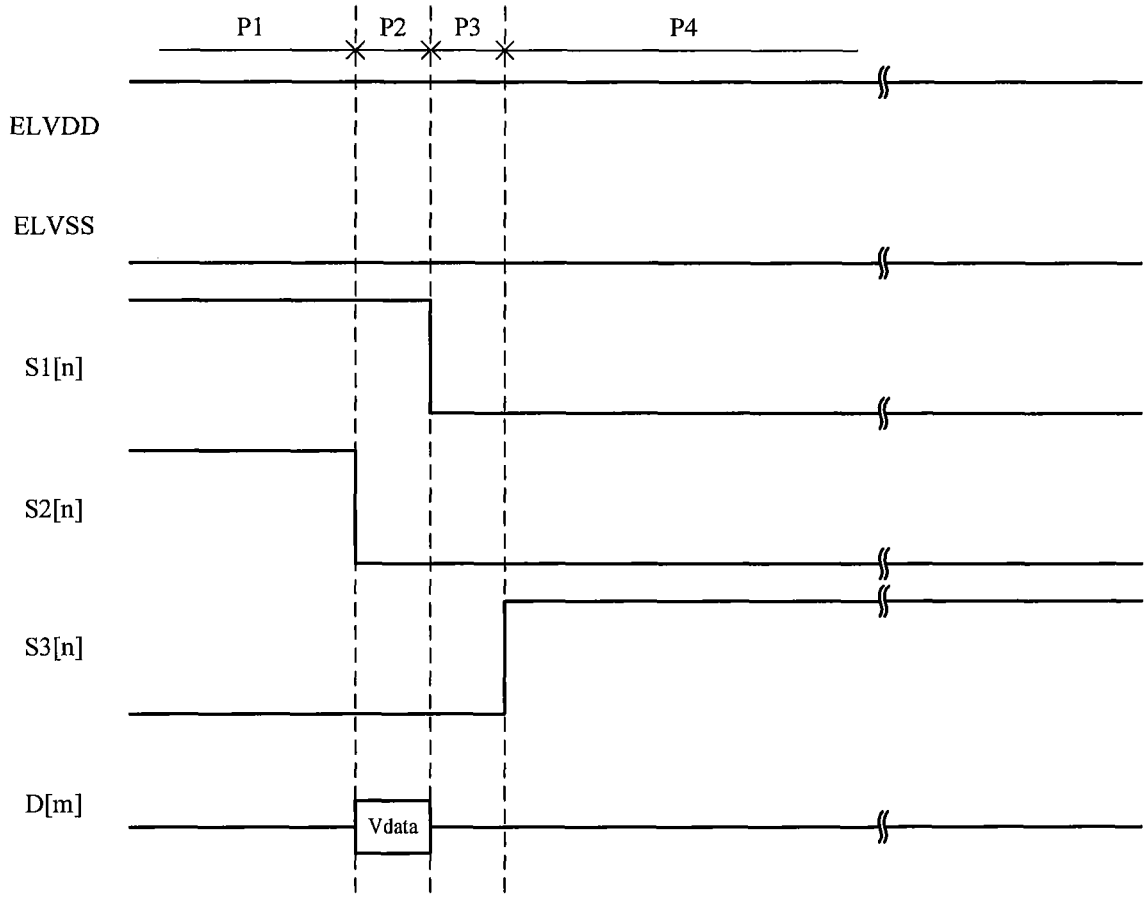
FIG. 3 is a timing diagram of the pixel circuit shown in FIG. 2.

FIG. 3 illustrates a timing diagram of the pixel circuit 200 shown in FIG. 2, and FIGS. 4 to 7 illustrate equivalent circuits of the pixel circuit 200 in different phases. Operation of the pixel circuit 200 will be described below in conjunction with FIGS. 3-7.

Figure 4:
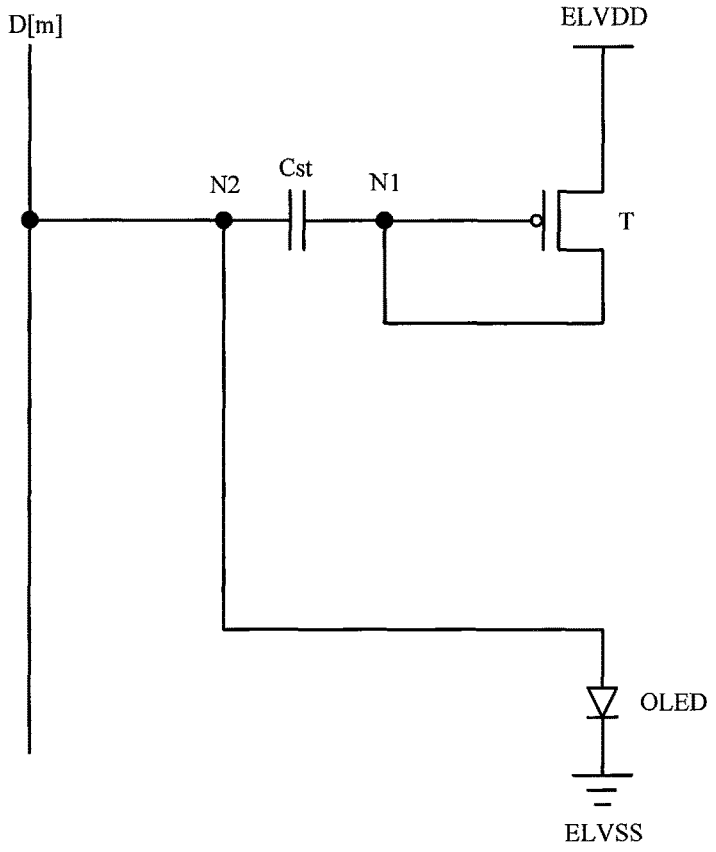
FIG. 4 is an equivalent circuit diagram of the pixel circuit shown in FIG. 2 in an initialization and compensation phase.

Referring to FIG. 3, in a phase P1, initialization and threshold voltage compensation are performed. Specifically, the first scan line S1[$n$] is supplied with an active signal, the second scan line S2[$n$] is supplied with an active signal, the third scan line S3[$n$] is supplied with an inactive signal, and the data line D[m] is supplied with a reference voltage $V_{ref}$. An equivalent circuit of the pixel circuit 200 is shown in FIG. 4. The reference voltage $V_{ref}$ in the data line D[m] is transmitted to the second node N2 via the turned-on first transistor T1. In an embodiment in which the fourth transistor T4 is provided, the reference voltage $V_{ref}$ in the data line D[m] is further transmitted to the fourth node N4, i.e. the anode of the light emitting device OLED, via the turned-on fourth transistor T4. The gate and the drain of the driving transistor T are connected to each other via the turned-on second transistor T2 such that the driving transistor T is in a diode-connecting state. In this state, the gate voltage of the driving transistor T (i.e. the potential at the first node N1) is equal to the drain voltage of the driving transistor T, and the drain-source voltage of the driving transistor T is equal to a threshold voltage $V_{th}$ of the driving transistor T. Therefore, the potential at the first node N1 is equal to the voltage $V_{dd}$ of the first power supply ELVDD minus the threshold voltage $V_{th}$ of the driving transistor T, i.e. ($V_{dd}$+$V_{th}$). As will be described below, this will enable cancellation of the item $V_{th}$, i.e. compensation for the threshold voltage, from the expression of the drain current of the driving transistor T.

Figure 5:
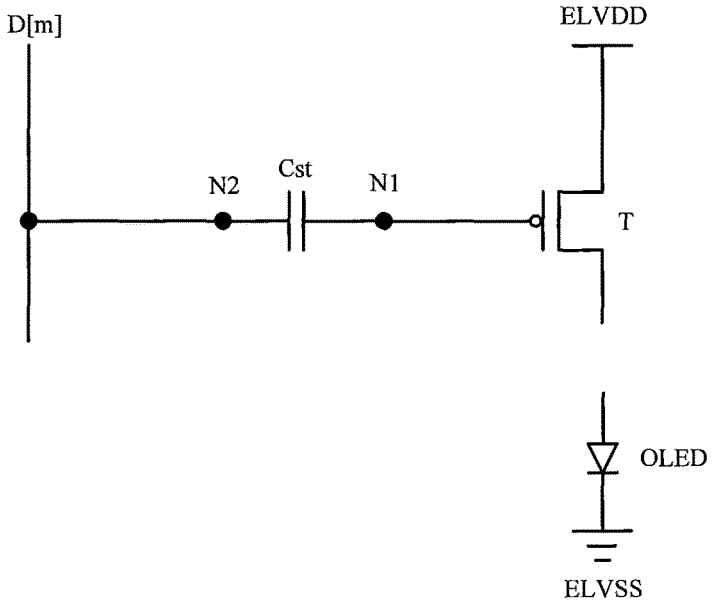
FIG. 5 is an equivalent circuit diagram of the pixel circuit shown in FIG. 2 in a writing phase.

In a phase P2, data writing is performed. Specifically, the first scan line S1[$n$] is supplied with an active signal, the second scan line S2[$n$] is supplied with an inactive signal, the third scan line S3[$n$] is supplied with an inactive signal, and the data line D[m] is supplied with a data voltage $V_{data}$. An equivalent circuit of the pixel circuit 200 is shown in FIG. 5. The data voltage $V_{data}$ in the data line D[m] is transmitted to the second node N2 via the turned-on first transistor T1, causing a jump in the potential at the second node N2 from $V_{ref}$ to $V_{data}$. Due to the bootstrap effect of the storage capacitor Cst, the potential at the first node N1 is also changed by ($V_{data}$−$V_{ref}$) that is, the potential at the first node N1 is changed to ($V_{dd}$+$V_{th}$+$V_{data}$−$V_{ref}$).

Figure 6:
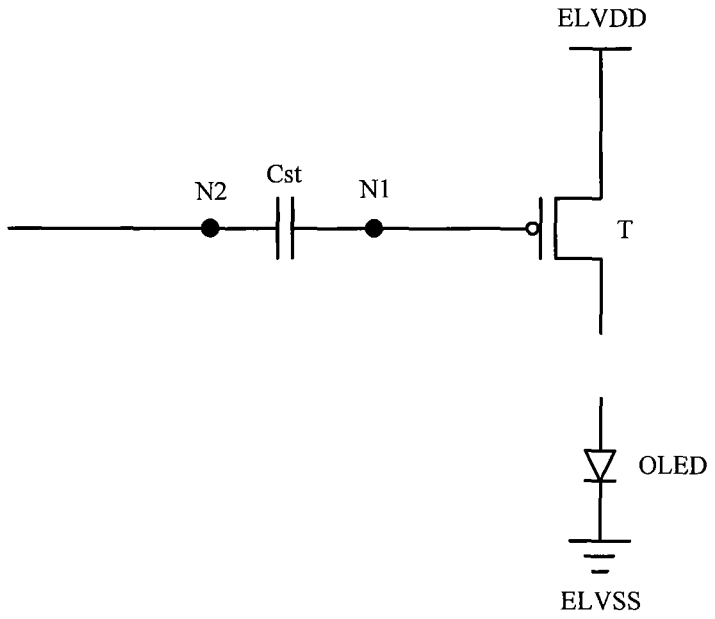
FIG. 6 is an equivalent circuit diagram of the pixel circuit shown in FIG. 2 in a maintaining phase.

In a phase P3, the potential at the first node N1 and the potential at the second node N2 are maintained. Specifically, the first scan line S1[$n$] is supplied with an inactive signal, the second scan line S2[$n$] is supplied with an inactive signal, and the third scan line S3[$n$] is supplied with an inactive signal. An equivalent circuit of the pixel circuit 200 is shown in FIG. 6. The second node N2 is disconnected from the data line D[m] by means of the turned-off first transistor T1 and is thus floated. The first node N1 is also floated. Thus, this phase P3 provides a short buffering interval in which the voltage across the storage capacitor Cst reaches a stable state. Of course, the phase P3 may be optional if the data voltage is sufficiently written into the storage capacitor Cst in the phase P2.

Figure 7:
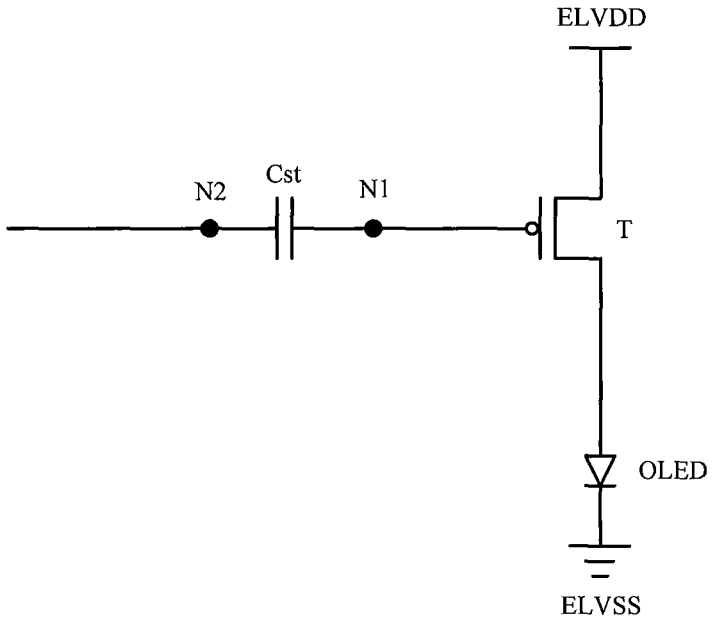
FIG. 7 is an equivalent circuit diagram of the pixel circuit shown in FIG. 2 in a light emitting phase.

In a phase P4, light emission is performed. Specifically, the first scan line S1[$n$] is supplied with an inactive signal, the second scan line S2[$n$] is supplied with an inactive signal, and the third scan line S3[$n$] is supplied with an active signal. An equivalent circuit of the pixel circuit 200 is shown in FIG. 7. The drain current of the driving transistor T may be calculated as:

$$\begin{aligned} I_D &= K(V_{gs} - V_{th})^2 \\ &= K((V_{dd} + V_{th} + V_{data} - V_{ref} - V_{dd}) - V_{th})^2 \\ &= K(V_{data} - V_{ref})^2 \end{aligned} \tag{1}$$

where K is a characteristic parameter of the driving transistor T, which is typically considered to be a constant, and $V_{gs}$ is a gate-source voltage of the driving transistor. As can be seen from equation (1), the current $I_D$ is related to the data voltage, but is independent of the threshold voltage $V_{th}$. Therefore, in theory, the pixel circuit 200 can eliminate the influence of the threshold voltage $V_{th}$ of the driving transistor T on the luminance of the light emitting device OLED (which is determined by the drain current $I_D$ of the driving transistor T).

The third transistor T3 is turned on in the phase P4, thereby providing a path allowing the driving current $I_D$ to flow from the first power supply ELVDD to the second power supply ELVSS via the driving transistor T and the light emitting device OLED. Thus, the light emitting device OLED is driven to emit light having an intensity corresponding to the magnitude of the driving current $I_D$. At the beginning of the next scan period, the pixel circuit 200 enters the phase P1 again.

Although the first to fourth transistors T1, T2, T3 and T4 are illustrated and described as N-type transistors in the above embodiments, P-type transistors are possible. In the case of a P-type transistor, the active signal has a low voltage level and the inactive signal has a high voltage level. Moreover, depending on the circuit implementation, the driving transistor T may be an N-type transistor in other embodiments. The transistors may be, for example, thin film transistors, which are typically fabricated such that their first and second terminals are used interchangeably.

Figure 8:
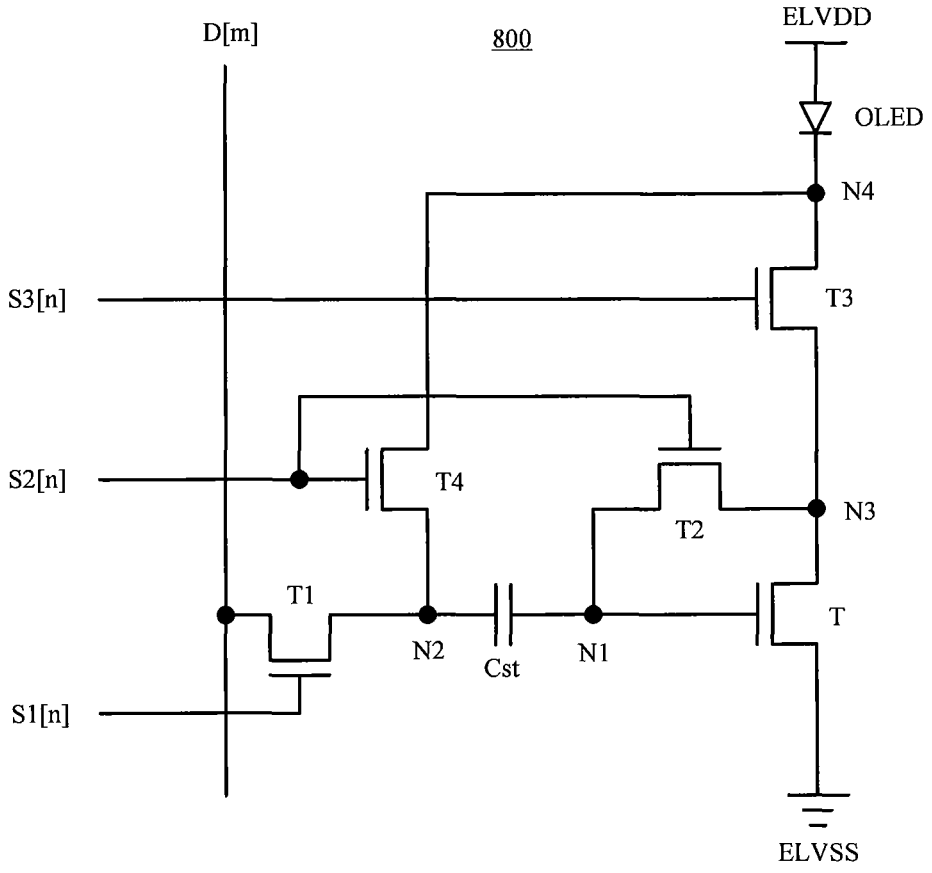
FIG. 8 is a circuit diagram of a pixel circuit according to an embodiment of the present disclosure.

FIG. 8 illustrates one possible pixel circuit 800 according to an embodiment of the present disclosure. The same reference numerals in FIGS. 2 and 8 denote the same elements. The pixel circuit 800 is different from the pixel circuit 200 shown in FIG. 2 in that the driving transistor T is now an N-type transistor having a gate connected to the first node N1, a source connected to the second power supply ELVSS, and a drain connected to the third node N3. In addition, the light emitting device OLED has an anode connected to the first power supply ELVDD and a cathode connected to the fourth node. The operation of pixel circuit 800 is similar to those previously described with respect to FIGS. 2 to 7, and is omitted here for the sake of brevity.

Figure 9:
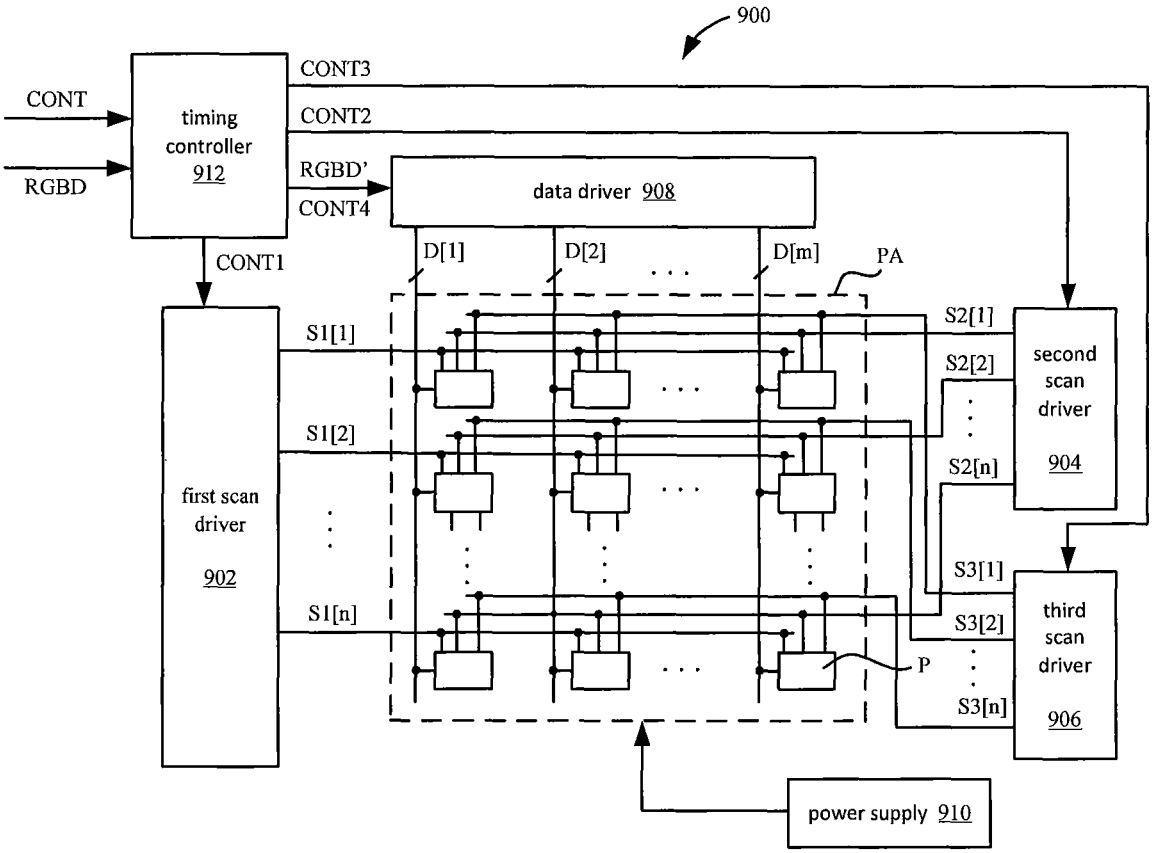
FIG. 9 is a circuit diagram of a display device according to an embodiment of the present disclosure.

FIG. 9 is a circuit diagram of a display device 900 according to an embodiment of the present disclosure. Referring to FIG. 9, the display device 900 comprises an array substrate PA, a first scan driver 902, a second scan driver 904, a third scan driver 906, a data driver 908, a power supply 910, and a timing controller 912. As an example rather than limitation, the display device 900 may be any product or component having a display function such as a mobile phone, a tablet computer, a television, a display, a notebook computer, a digital photo frame, a navigator, and the like.

The array substrate PA includes n×m pixels P. Each pixel P may take the form of the pixel circuit 200 or 800 as described above. The array substrate PA includes n first scan lines S1[1], S1[2], . . . , S1[*n*] arranged in a row direction to transmit first scan signals, n second scan lines S2[1], S2[2], . . . , S2[*n*] arranged in the row direction to transmit second scan signals, n third scan lines S3[1], S3[2], . . . , S3[*n*] arranged in the row direction to transmit third scan signals, m data lines D[1], D[2], . . . , D[m] arranged in a column direction to transmit voltage signals, and wires (not shown) for supplying a power supply voltage from the power supply 910 to the respective pixels. n and m are natural numbers.

The timing controller 912 is used to control operations of the first scan driver 902, the second scan driver 904, the third scan driver 906, and the data driver 908. The timing controller 912 receives input image data RGBD and an input control signal CONT from an external apparatus (e.g. host). The input image data RGBD may include a plurality of input pixel data for a plurality of pixels. Each input pixel data may include red grayscale data R, green grayscale data G, and blue grayscale data B for a corresponding one of the plurality of pixels. The input control signal CONT may include a main clock signal, a data enable signal, a vertical sync signal, a horizontal sync signal, and the like. The timing controller 912 generates output image data RGBD', a first control signal CONT1, a second control signal CONT2, a third control signal CONT3 and a fourth control signal CONT4 based on the input image data RGBD and the input control signal CONT.

Specifically, the timing controller 912 may generate output image data RGBD' based on the input image data RGBD. The output image data RGBD' may be compensated image data generated by compensating the input image data RGBD using a compensation algorithm. The output image data RGBD' is supplied to the data driver 908. In addition, the first control signal CONT1, the second control signal CONT2, and the third control signal CONT3 are supplied to the first scan driver 902, the second scan driver 904, and the third scan driver 906 respectively, and the driving timings of the first scan driver 902, the second scan driver 904, and the third scan driver 906 are controlled based on the first control signal CONT1, the second control signal CONT2, and the third control signal CONT3 respectively. The first control signal CONT1, the second control signal CONT2, and the third control signal CONT3 may include a vertical start signal, a gate clock signal, and the like. The fourth control signal CONT4 is supplied to the data driver 908, and the driving timing of the data driver 908 is controlled based on the fourth control signal CONT4. The fourth control signal CONT4 may include a horizontal start signal, a data clock signal, a data load signal, and the like.

The first scan driver 902 generates a plurality of first scan signals based on the first control signal CONT1. The first scan driver 902 is connected to the first scan lines S1[1], S1[2], . . . , S1[*n*] to apply the generated first scan signals to the array substrate PA.

The second scan driver 904 generates a plurality of second scan signals based on the second control signal CONT2. The second scan driver 904 is connected to the second scan lines S2[1], S2[2], . . . , S2[*n*] to apply the generated second scan signals to the array substrate PA.

The third scan driver 906 generates a plurality of third scan signals based on the third control signal CONT3. The third scan driver 906 is connected to the third scan lines S3[1], S3[2], . . . , S3[*n*] to apply the generated third scan signals to the array substrate PA.

The data driver 908 receives the fourth control signal CONT4 and the output image data RGBD' from the timing controller 912. The data driver 908 generates a plurality of data voltages based on the fourth control signal CONT4 and the output image data RGBD'. The data driver 908 is connected to the data lines D[1], D[2], . . . , D[m] to apply the reference voltage and the data voltages to the array substrate PA.

The power supply 910 may function as the first power supply ELVDD and the second power supply ELVSS as described above to supply power to the array substrate PA. Examples of the power supply 910 include, but are not limited to, a DC/DC converter and a low dropout regulator (LDO).

It is to be understood that the above contents are merely exemplary embodiments for the purpose of illustrating the principles of the present disclosure. However, the present disclosure is not so limited. Various modifications and improvements may be made by those ordinarily skilled in the art without departing from the scope of the present disclosure.

The invention claimed is:

1. A pixel circuit comprising:

a light emitting device;

a driving transistor configured to control a magnitude of a driving current supplied from a first power supply to the light emitting device in response to a first potential at a first node;

a storage capacitor configured to change the first potential at the first node in response to a change in a second potential at a second node;

a first circuit configured to transmit a voltage in a data line to the second node in response to a first signal in a first scan line being active;

a second circuit configured to bring the driving transistor into a diode-connecting state in response to a second signal in a second scan line being active; and a third circuit configured to provide a path for the driving current to flow from the first power supply to a second power supply via the driving transistor and the light emitting device in response to a third signal in a third scan line being active, wherein the driving transistor comprises a gate connected to the first node and a drain connected to a third node, wherein the third circuit is connected to the third scan line, the third node and a fourth node respectively, wherein the pixel circuit further comprises a fourth transistor connected between the second node and the fourth node for bringing the second node into conduction with the fourth node in response to the second signal in the second scan line being active, and wherein a type of the driving transistor is opposite to a type of the fourth transistor.

2. The pixel circuit according to claim 1, wherein the storage capacitor is connected between the first node and the second node.

3. The pixel circuit according to claim 2, wherein the first circuit comprises:

a first transistor comprising a second gate connected to the first scan line, a first terminal connected to the data line, and a second terminal connected to the second node.

4. The pixel circuit according to claim 3, wherein the second circuit comprises:

a second transistor comprising a third gate connected to the second scan line, a third terminal connected to the first node, and a fourth terminal connected to the third node.

5. The pixel circuit according to claim 1, wherein the driving transistor comprises a P-type transistor comprising a source terminal connected to the first power supply, and wherein the light emitting device is connected between the fourth node and the second power supply.

6. The pixel circuit according to claim 1, wherein the driving transistor comprises an N-type transistor comprising a source terminal connected to the second power supply, and wherein the light emitting device is connected between the first power supply and the fourth node.

7. The pixel circuit according to claim 1, wherein the light emitting device comprises an organic light emitting diode.

8. A method for driving a pixel circuit according to claim 1, the method comprising:

transmitting, by the first circuit, a reference voltage in the data line to the second node in an initialization and compensation phase;

bringing, by the second circuit, the driving transistor into a diode-connecting state in the initialization and compensation phase;

transmitting, by the first circuit, a data voltage in the data line to the second node in a writing phase, thereby causing a change in the second potential at the second node;

causing, by the storage capacitor, a change in the first potential at the first node in response to the change in the second potential at the second node in the writing phase;

controlling, by the driving transistor, a magnitude of the driving current supplied from the first power supply to the light emitting device in response to the first potential at the first node in a light emitting phase; and providing, by the third circuit, a path for the driving current to flow from the first power supply to the second power supply via the driving transistor and the light emitting device in the light emitting phase, thereby driving the light emitting device to emit light.

9. The method according to claim 8, further comprising:

maintaining the first potential at the first node and the second potential at the second node in a maintaining phase between the writing phase and the light emitting phase.

10. The method according to claim 9, further comprising:

in the maintaining phase, supplying a first inactive signal to the first scan line, supplying a second inactive signal to the second scan line, and supplying a third inactive signal to the third scan line.

11. The method according to claim 8, further comprising:

in the initialization and compensation phase, supplying a first active signal to the first scan line, supplying a second active signal to the second scan line, supplying a third inactive signal to the third scan line, and supplying the reference voltage to the data line;

in the writing phase, supplying the first active signal to the first scan line, supplying a second inactive signal to the second scan line, supplying the third inactive signal to the third scan line, and supplying the data voltage to the data line; and in the light emitting phase, supplying a first inactive signal to the first scan line, supplying the second inactive signal to the second scan line, and supplying a third active signal to the third scan line.

12. An array substrate comprising:

a plurality of first scan lines configured to transmit first scan signals;

a plurality of second scan lines configured to transmit second scan signals;

a plurality of third scan lines configured to transmit third scan signals;

a plurality of data lines configured to transmit respective voltage signals; and a plurality of pixels in an array, ones of the plurality of pixels comprising:

a light emitting device;

a driving transistor configured to control a magnitude of a driving current supplied from a first power supply to the light emitting device in response to a first potential at a first node;

a storage capacitor configured to change the first potential at the first node in response to a change in a second potential at a second node;

a first circuit configured to transmit a respective one of the voltage signals in a corresponding one of the plurality of data lines to the second node in response to a first scan signal in a corresponding one of the plurality of first scan lines being active;

a second circuit configured to bring the driving transistor into a diode-connecting state in response to a second scan signal in a corresponding one of the plurality of second scan lines being active; and a third circuit configured to provide a path for the driving current to flow from the first power supply to a second power supply via the driving transistor and the light emitting device in response to a third scan signal in a corresponding one of the plurality of third scan lines being active, wherein the driving transistor comprises a gate connected to the first node and a drain connected to a third node, wherein the third circuit is connected to the third scan line, the third node and a fourth node respectively, wherein a fourth transistor is connected between the second node and the fourth node for bringing the second node into conduction with the fourth node in response to the second scan signal in the second scan line being active, and wherein a type of the driving transistor is opposite to a type of the fourth transistor.

13. The array substrate according to claim 12, wherein the storage capacitor is connected between the first node and the second node.

14. The array substrate according to claim 13, wherein the first circuit comprises:

a first transistor comprising a second gate connected to the corresponding one of the plurality of first scan lines, a first terminal connected to the corresponding one of the plurality of data lines, and a second terminal connected to the second node.

15. The array substrate according to claim 14, wherein the second circuit comprises:

a second transistor comprising a third gate connected to the corresponding one of the plurality of second scan lines, a third terminal connected to the first node, and a fourth terminal connected to the third node.

16. A display device comprising:

the array substrate according to claim 12;

a first scan driver configured to supply the first scan signals to the plurality of first scan lines;

a second scan driver configured to supply the second scan signals to the plurality of second scan lines;

a third scan driver configured to supply the third scan signals to the plurality of third scan lines; and a data driver configured to supply the voltage signals to the plurality of data lines.

* * * * *